United States Patent [19]

Schmidt, Jr.

[11] 4,132,316

[45] Jan. 2, 1979

[54] DISPLAY AND CLAMP DEVICE

[76] Inventor: Joseph D. Schmidt, Jr., 1909 Lincoln Ave., Chicago, Ill. 60614

[21] Appl. No.: 594,442

[22] Filed: Jul. 9, 1975

Related U.S. Application Data

[63] Continuation-in-part of Ser. No. 494,514, Aug. 5, 1974, abandoned.

[51] Int. Cl.[2] ..... A47F 7/10

[52] U.S. Cl. ..... 211/13; 211/113; 223/87; 248/340

[58] Field of Search ..... 223/85, 87, 88, 91, 223/96, DIG. 1; 211/113, 10, 13, 6; 24/DIG. 29, 84 R; 248/340, 339

[56] References Cited

U.S. PATENT DOCUMENTS

| | | | |
|---|---|---|---|
| 1,027,223 | 5/1912 | Sybenga | 223/96 |
| 2,994,462 | 8/1961 | Hirsch et al. | 223/85 |
| 3,381,865 | 5/1968 | Pehr | 223/87 |
| 3,414,944 | 12/1968 | Rabinowitz | 24/DIG. 29 |
| 3,774,267 | 11/1973 | Sneider | 24/DIG. 29 |
| 3,900,181 | 8/1975 | Pitanis | 223/87 X |
| 3,997,091 | 12/1976 | Burnette | 223/87 |

FOREIGN PATENT DOCUMENTS

| | | | |
|---|---|---|---|
| 250232 | 3/1964 | Australia | 223/87 |
| 1116387 | 1/1956 | France | 223/87 |
| 1385234 | 11/1964 | France | 223/96 |
| 1519846 | 2/1968 | France | 223/96 |

*Primary Examiner*—George H. Krizmanich
*Attorney, Agent, or Firm*—Laff, Whitesel & Rockman

[57] ABSTRACT

An integral two-part, preferably plastic device includes a hanger and a plate-like member. There is a localized area between the two parts so that they may be separated. The hanger supports products before sale, and the plate-like member keeps together a pair of products, after the sale. A pair of socks is exemplary of the products.

4 Claims, 12 Drawing Figures

DISPLAY AND CLAMP DEVICE

This is a continuation-in-part of a pending prior application Ser. No. 494,514, filed on Aug. 5, 1974, now abandoned, of Joseph D. Schmidt, Jr. for Display and Clamp Device.

BACKGROUND OF THE INVENTION

This invention relates to hangers and more particularly to hangers for pairs of products or items, such as socks, stockings, gloves, or the like (hereinafter generically called "socks"). The invention also relates to a device for keeping these items in pairs.

There are a number of reasons why hangers of this type might be used. At the point of sales, it is convenient to hang a pair of socks in a manner which displays them to the view of potential purchasers. Thus, a shopper can make a selection at a glance. Therefore, most manufacturers have adopted the practice of packing low cost, light weight (usually plastic) hangers in with their socks. Then, the sock clerk only has to attach the hangers on a rack, and the socks are on display in a manner which the manufacturer selected. Usually, the purchaser of the socks throws away the hanger and that is the end of the plastic part.

If the manufacturer makes the hanger in a form which is useful to the purchaser, he will keep it. Then, the purchaser sees any advertising on the hanger over a long period of time. Thus, the hanger does the double duty of serving as a point of purchase display device and a continuing "business card" for the manufacturer.

From the purchaser's point of view, there is a very troublesome problem in keeping socks in pairs. The usual practice is for a pair of socks to become separated during laundering. Then, many socks are collected into an unsorted mass in the bottom of a drawer. The user generally has to rummage through the mass until he finds two socks which appear to match. This takes time and sometimes results in people wearing socks which do not really match.

Thus, the manufacturers have a need for a point of purchase hanger and the purchaser has a need for a device for keeping together a pair of socks during laundering.

Accordingly, an object of the invention is to provide point of purchase sock hangers combined with a socks sorter, for use throughout the life of the socks. Here, an object is to provide a hanger and sorter having separate utility. In particular, an object is to provide a device which is initially useful to the manufacturer and thereafter useful to the purchaser.

Another object is to provide an advertisement and promotional system. In general detail, an object is to provide an advertisement for the sale of socks and for the promotion of future sales of socks.

SUMMARY OF THE INVENTION

In keeping with an aspect of the invention, these and other objects are accomplished by providing an integral two-part plastic device consisting of a hanger and a platelike-member, which might be described as a sorter, for convenience of expression. There is a score mark or other locally formed separation area between the two parts. Therefore, they may be cut or snapped apart in that area after purchase and thereafter the sorter may be used independently for keeping the socks together during laundering or storage.

DESCRIPTION OF THE PREFERRED EMBODIMENTS

Figure 1:
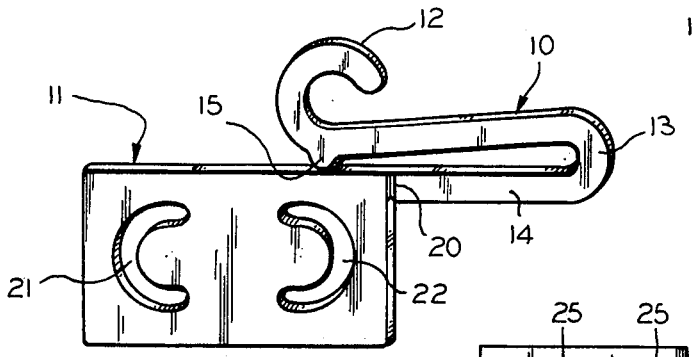
FIG. 1 is a plan view of a first embodiment of the invention.
Figure 2:
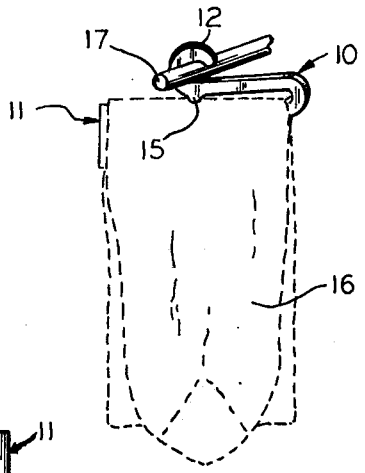
FIG. 2 is a schematic view of the hanger feature of the invention in use at a point of purchase display rack.
Figure 3:
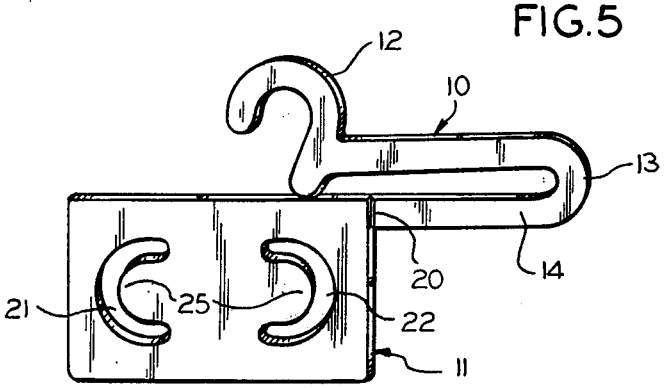
FIG. 3 is a plan view of a second embodiment of the invention.

The integral, two-part, preferably plastic, inventive device includes a hanger 10, and a plate-like sorter 11. The hanger 10 includes a U-shaped rod-like member which begins at a hook 12, extends toward one side for a distance which is about one-half the width of a folded pair of socks, folds back upon itself in a bight at 13, and returns toward the opposite side as a horizontal bar 14 for the approximate width of the folded pair of socks. The hook 12 is located near the center of gravity of the two-part device with the pair of socks hanging thereon. A detent or bump 15 appears near the hook 12. Thus, a pair of socks 16 (FIG. 2) may be slipped over the bar 14, under the bump 15, and into the bight 13. Heavy ink is used to outline the area into which the socks slip. Then, the hook 12 may be fitted over a bar or rack 17 at the point of purchase. In the embodiment of FIG. 3, the hook 12 has a reverse bend which is particularly useful for some racks or bars. This way, the entire width of the socks are exposed to view at the point of purchase.

A score mark or weakened area 20 separates the hanger 10 from the sorter 11. By cutting or breaking along the scored area 20, the hanger may be separated from the sorter 11. The sorter 11 may or may not carry any suitable advertisement. When the inventive device is used as a novelty or premium, the sorter 11 may have advertising imprinted or embossed thereon, which may, e.g., identify the manufacturer or the store from which the socks were purchased. In this way, the sorter 11 acts as a business card.

Figure 5:
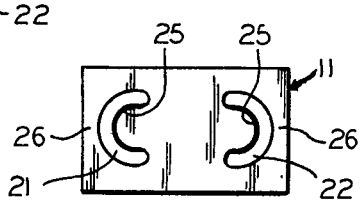
FIG. 5 is a separate and discrete sorter which does not provide a hanger element.

Of course, the sorter 11 may also be made as a discrete element and used entirely separate from the hanger, as shown in FIG. 5. In this embodiment, it may be either a separately-sold item or a give-away item. The advertisement might be appropriate for a give-away, but not used when sold separately.

Figure 6:
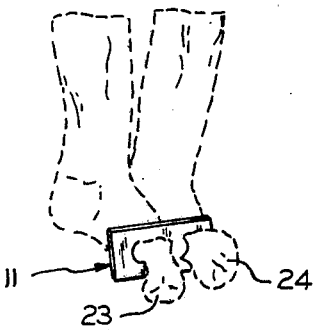
FIG. 6 shows a preferred method of using the sorter.
Figure 4:
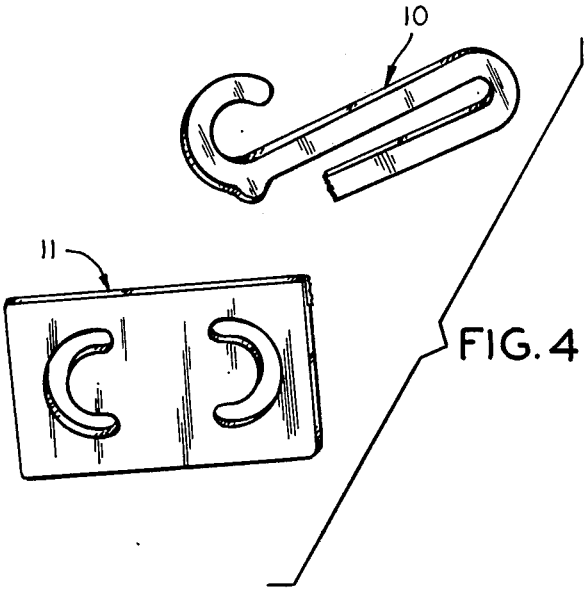
FIG. 4 is a schematic representation of how the hanger and sorter may be separated into two parts.

FIG. 6 shows the preferred method of usage for the sorter 11. Two crescent-shaped openings 21, 22 are provided in the sorter 11. At the center of each crescent opening, there is a tongue 25 for capturing a sock. The tongue 25 is outlined in heavy ink (FIG. 5) for easy identification. As shown in FIG. 6, the toes of each of a pair of socks 23, 24 may be slipped through these crescent openings. Then, the socks may be pulled until there is a sufficient binding against the tongue 25 to hold them in place. When a sock is pulled through the crescent opening, the end 26 (FIG. 5) of the sorter 11 opposite the tongue 25 flexes so that the opening will adjust to the size, thickness, and weight of the sock. After the pulling motion is stopped, the flexed end will return to its normal position to hold the sock in place. In this way, the sorter 11 is self-adjusting so as to accommodate socks for infants, children, or adults, i.e., socks of all sizes, shapes and thicknesses. If a pair of socks are usually small and thin, such as socks for a tiny infant, both socks of a pair may be inserted into one of the crescent openings of the sorter 11. Once a sock is in the sorter, the tongue binds the sock against the opposite end of the crescent opening and secures the sock in place. A pair of socks is thereby kept together throughout laundering and in storage in the drawer.

Figure 7:
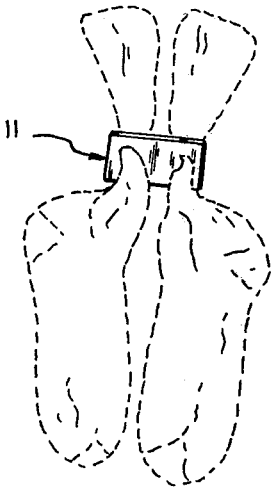
FIG. 7 shows an alternative method of using the sorter.
Figure 8:
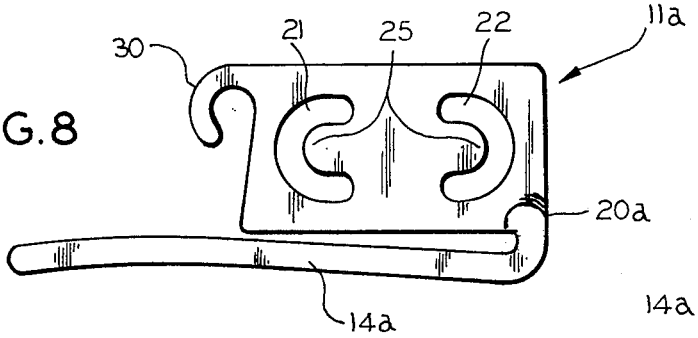
FIG. 8 is a plan view of a third embodiment of the invention.
Figure 9:
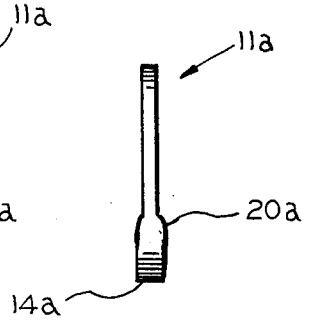
FIG. 9 is an end view taken along line 9—9 of FIG. 8.
Figure 10:
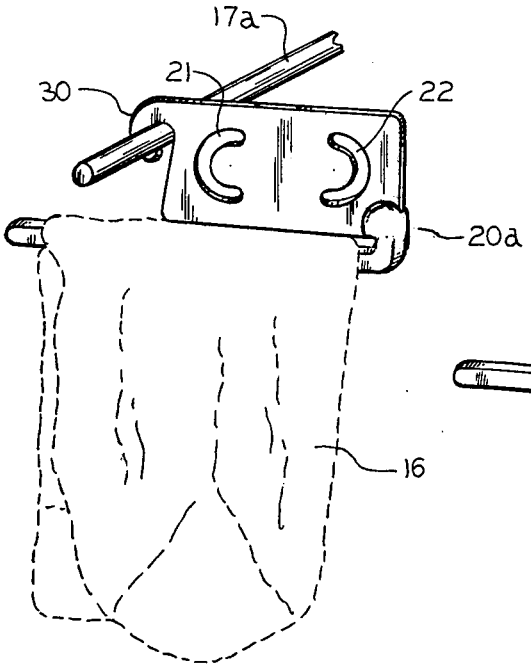
FIG. 10 is a schematic view of the hanger of the third embodiment in use at a point of purchase display rack.

An alternative usage (FIG. 7), has the top of the socks fitting through the crescent openings. Again, the binding against tongue 25 is such that the socks do not come apart during either laundering or storing.

FIGS. 8-12 show a third embodiment wherein the sorter **11*a* has a integral hook 30 which may be used to hang socks, both at the time of the original sale and later during separate utilization of the sock sorter. In greater detail, the third embodiment of the sock sorter comprises the plate 11*a* made in the general form and geometry explained above and a hanger bar 14*a* which is a somewhat different design than the hanger 14** of the first embodiment.

In addition to the crescent-shaped openings 21, 22 and the tongues 25, the plate **11*a* includes an integral hook 30 which may be used to hang the structure. A bar 14*a* is initially attached to the bottom of the plate to receive a pair of socks. For added strength and stability, one or more beads (not shown) may extend along the length of bar 14*a* or it is simply made thicker as here shown. The beads or other thickness may be placed on either side of the bar or on both sides. The bar 14*a* may be imprinted with instructions or advertising. The geometry of the device is such that the hook 30 is located at approximately the center of gravity when the socks 16 are in place on the bar 14*a*. Therefore, the socks 16 will hange vertically when the hook 30 is attached over the bar 17*a***.

Figure 11:
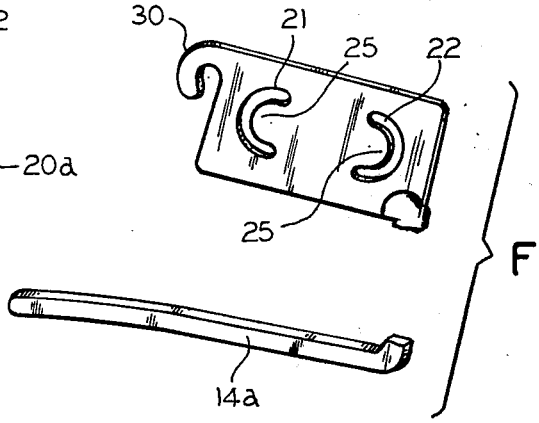
FIG. 11 is a schematic representation of how the hanger and sorter of FIGS. 8, 9 may be broken apart.
Figure 12:
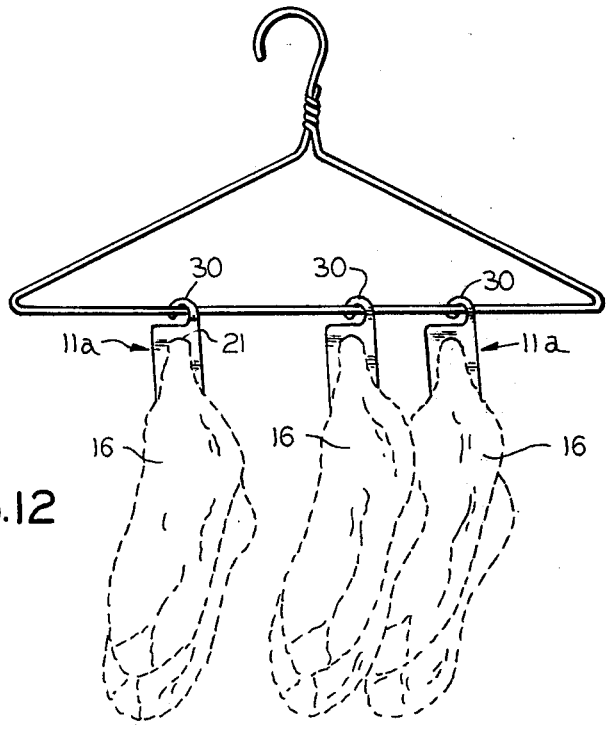
FIG. 12 is a schematic representation of how the sorter of FIG. 12 may be used to store socks after the hanger and sorter are broken apart.

As before, there is a localized area 20 which facilitates a separation of the bar **14*a* from the sock sorter 11*a* when either broken or cut away, as shown in FIG. 11. Therefore, the sorter 11*a* remains for future use. Thereafter a pair of socks may be fed through crescent opening 21, 22. When socks are so captured in openings 21, 22, the hook 30 is aligned with the center of gravity when the sorter hangs vertically as shown in FIG. 12**. This way, a number of socks may be hung from a coat hanger, hook, or the like.

A major advantage of hanging socks as shown in FIG. 12 is that they may be hung up to dry, after laundering.

While the various embodiments of sorter 11 are shown in connection with pairs of socks, it can be used to sort and keep together pairs of other items, such as gloves, mittens, or the like. The present invention can also be used for industrial and commercial, as well as domestic purposes.

Those skilled in the art will readily perceive how the invention may be modified. Therefore, the appended claims are to be construed to cover all equivalent structures falling within the scope and spirit of the invention.

I claim:

1. An integral two-part device consisting of hanger means attached to the bottom of a plate-like sorter part means having a hook extension projecting away from a side of the plate-like sorter part, said hanger and plate means having between them a mechanically weak local area adapted to be separated responsive to an application of a breaking force thereto, said plate member having a pair of openings through which at least two socks or like products may be pulled, to keep said two socks or like products together during laundry or storage, whereby said pair of socks or like products may be hung on said hanger means for point of purchase display, the center of gravity of said device being at the center of the hook when the pair of socks are hung on said hanger, said hanger means may be thereafter separated from said sorter, and said sorter may be used to hold together and in association with each other a pair of socks or like products which have been individually fitted through said openings during said laundry or storage.

2. The device of claim 1 wherein said each of said openings is crescent-shaped for individually receiving one of two socks or the like when said socks are pulled through the opening.

3. The device of claim 1 wherein said hook is also located at a center of gravity of said plate member alone after the hanger has been separated therefrom, the last-named center of gravity being taken when the device is loaded with a pair of socks or similar products individually fitted through said openings.

4. A sorter of socks or similar articles comprising a plastic plate having a pair of crescent-shaped openings formed therein, each of said openings being formed in an area of said plate which is adapted to receive an article pulled through it with a binding fit, each end of said sorter being adapted to flex when an article is pulled through one of said openings in order to adjust said openings to grip a pair of articles of different sizes, thicknesses, and weights, one hook integrally formed on one upper corner of said plastic plate for hanging said sorter in either of two stable positions, the hook integrally formed on said plate being located near a center of gravity of said plate in each of said two stable positions, said center of gravity in one of said stable positions being taken when the device is loaded with a pair of articles individually fitted through said openings, and hanger means beginning on another corner and at the bottom of said plastic plate, said other corner being diagonally across said plate from said one corner, said hanger then forming a bight and then extending back under and substantially parallel to the bottom of the plate, thereby forming a cove for receiving said articles, said center of gravity in the other of said stable positions being taken when said hanger means is loaded with said articles.

* * * * *